US008529031B2

(12) United States Patent
Ikeda

(10) Patent No.: US 8,529,031 B2
(45) Date of Patent: Sep. 10, 2013

(54) LIQUID DISCHARGE DEVICE AND LIQUID DISCHARGE METHOD

(75) Inventor: Kouji Ikeda, Hyogo (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/818,106

(22) PCT Filed: Feb. 14, 2012

(86) PCT No.: PCT/JP2012/000960
§ 371 (c)(1),
(2), (4) Date: Feb. 21, 2013

(87) PCT Pub. No.: WO2012/111313
PCT Pub. Date: Aug. 23, 2012

(65) Prior Publication Data

US 2013/0155133 A1 Jun. 20, 2013

(30) Foreign Application Priority Data

Feb. 15, 2011 (JP) ..... 2011-030234

(51) Int. Cl.
*B41J 2/175* (2006.01)
*B41J 2/195* (2006.01)

(52) U.S. Cl.
USPC ..... 347/85; 347/7

(58) Field of Classification Search
CPC ..... B41J 2/17513; B41J 2/17596
USPC ..... 347/7, 9, 84–86
See application file for complete search history.

(56) References Cited

U.S. PATENT DOCUMENTS

| | | | | |
|---|---|---|---|---|
| 5,729,256 | A * | 3/1998 | Yamanaka et al. | 347/7 |
| 5,881,914 | A | 3/1999 | Tsuda et al. | |
| 8,002,372 | B2 * | 8/2011 | Matsuda | 347/7 |
| 2010/0295905 | A1 * | 11/2010 | Tamaki | 347/85 |

FOREIGN PATENT DOCUMENTS

| | | |
|---|---|---|
| JP | 10-099756 | 4/1998 |
| JP | 2008-307466 | 12/2008 |

OTHER PUBLICATIONS

International Search Report issued May 22, 2012 in International (PCT) Application No. PCT/JP2012/000960.

* cited by examiner

*Primary Examiner* — An Do
(74) *Attorney, Agent, or Firm* — Wenderoth, Lind & Ponack, L.L.P.

(57) ABSTRACT

A liquid discharge device including a discharge unit including: an elastic discharge part including a storage chamber at least partially formed of an elastic component, a supply hole which leads to the storage chamber and through which liquid is supplied to the storage chamber, and a discharge hole through which the liquid is discharged; and an actuating unit configured to vary a volumetric capacity of the storage chamber. The liquid discharge device further includes: a pressurizing unit configured to pressurize the liquid to be supplied to the storage chamber to a pressure within a stable range; a supply control unit configured to control whether the pressurized liquid is supplied to the storage chamber; and an actuation control unit configured to control operation of the actuating unit.

5 Claims, 10 Drawing Sheets

LIQUID DISCHARGE DEVICE AND LIQUID DISCHARGE METHOD

TECHNICAL FIELD

The present invention relates to liquid discharge devices and liquid discharge methods for discharging droplets of a liquid, and in particular relates to a liquid discharge device and liquid discharge method in which liquids containing dispersed solid matter and high viscosity liquids can be used and in which the amount of liquid that is discharged can be accurately controlled.

BACKGROUND ART

One conventional printing technique includes an ink jetting technique of discharging droplets of ink in precise locations to print an image on a piece of paper. In recent years, this ink jetting technique has been used in manufacturing processes for all sorts of devices to form patterns and thin, uniform films, for example.

Furthermore, a liquid discharge device capable of discharging a variety of liquids is required for this ink jetting technique to be used widely in fields other than print and graphics. For example, in order for a blue light emitting diode (LED) to emit a white light, a clear resin layer dispersed with fine-grained phosphor must be deposited on the surface of the LED. To deposit such a layer, a liquid discharge device for discharging a liquid containing solid matter is required. Moreover, in order to discharge the high viscosity thermo setting resin required in the semiconductor device manufacturing process, a liquid discharge device capable of discharging an accurate amount of a high viscosity liquid is required.

An example of a device capable of discharging various types of liquids is disclosed in Patent Literature (PTL) 1. The liquid discharge device disclosed in PTL 1 includes a storage chamber, which stores a liquid to be discharged, having a variable volumetric capacity provided such that a supply hole for supplying the liquid leads to a discharge hole for discharging the liquid. The liquid is discharged from the discharge hole by reducing the volumetric capacity of the storage chamber for a short period of time.

With a liquid discharge device having this structure, no damage is incurred by the solid matter contained in the liquid seeping between the rigid parts and causing friction. Moreover, it is possible to discharge a high viscosity liquid since the force that reduces the volumetric capacity of the storage chamber is great.

CITATION LIST

Patent Literature

[PTL 1] Japanese Unexamined Patent Application Publication No. 2008-307466

SUMMARY OF INVENTION

Technical Problem

However, with the above-described structure of the liquid discharge device, while it is possible to accurately discharge a definite amount of liquid by filling a discharge hole to the brim with the liquid, a problem arises in that it takes a long time to fill the whole discharge hole with the liquid because the discharge hole is filled with the liquid by surface tension. Moreover, if the volumetric capacity of the discharge hole is increased for the purpose of increasing the amount of liquid discharged, the time it takes to fill the discharge hole with the liquid increases even further, meaning discharging a large volume of liquid within a given period of time becomes problematic.

Furthermore, with the above-mentioned liquid discharge device having a structure which is in series between supply hole and the discharge hole via the storage chamber, when pressure is applied to the liquid to increase the filling speed and the supply of liquid is forced, there is a hazard that the liquid could leak from the discharge hole due to the pressure applied to the liquid to be supplied, making it difficult to yield a high discharge rate while maintaining stability.

However, the inventor has found, through research and repeated experiments, that rapid filling is possible while reducing factors that adversely affect accuracy and while avoiding problems such as leakage, by stopping the application of pressure to the liquid under a suitable condition even when the pressure applied to the liquid to be supplied to the storage chamber or the discharge hole is increased.

The present invention is based on the above knowledge, and aims to provide a liquid discharge device and a liquid discharge method capable of discharging an accurate amount of liquid at high speed.

Solution to Problem

In order to achieve the above-describe objective, a liquid discharge device includes a discharge unit configured to discharge a droplet of a liquid including: an elastic discharge part including a storage chamber at least partially formed of an elastic component, a supply hole which leads to the storage chamber and through which the liquid is supplied to the storage chamber, and a discharge hole through which the liquid stored in the storage chamber is discharged; and an actuating unit configured to vary a volumetric capacity of the storage chamber, and the liquid discharge device further including: a pressurizing unit configured to pressurize the liquid to be supplied to the storage chamber to a pressure within a stable range; a supply control unit configured to control whether the pressurized liquid is supplied to the storage chamber; and an actuation control unit configured to control operation of the actuating unit.

With this, it is possible to rapidly fill the storage chamber and the discharge hole with the liquid while reducing factors that adversely accuracy because the liquid can be supplied to the storage chamber while pressurized. Moreover, even when the viscosity of the liquid is high, it is possible to rapidly fill the storage chamber and such while reducing factors that adversely accuracy. Furthermore, by controlling the discharge timing of the liquid with the actuation control unit while also controlling the timing of the supply of the pressurized liquid (hereinafter also referred to as pressurized supply liquid) to the storage chamber with the supply control unit, it is possible to suitably adjust the amount of liquid to be discharged.

Consequently, it is possible to discharge an accurate amount of liquid regardless of the viscosity and discharge liquid at high speed while reducing factors that adversely accuracy.

Furthermore, because the liquid is pressurized to within a stable range by the pressurizing unit, the liquid will not inadvertently leak from the discharge hole even if there is a slight error in the control timing by the supply control unit or the actuation control unit.

It is difficult to demarcate the "stable range" since it is dependent on the viscosity and surface tension of the liquid as well as the diameter and length of the discharge hole.

However, the inventor has found, through repeated experiments, that the stable range is a range of the supply liquid pressure in which, under specific conditions that the length of time that the pressurized supply liquid is supplied is constant and that the volumetric capacity of the storage chamber is decreased in order to discharge the liquid, the flying speed of the discharged droplet (hereinafter also referred to as droplet velocity; strictly speaking, since the speed of the droplet decreases due to air resistance and rebound force when a column of the discharged liquid is severed as the liquid becomes a droplet, flying speed indicates an average speed within a given period) becomes constant when the pressure of the pressurized supply liquid is changed.

Moreover, the constant flying speed of the droplet confirms that the volume of the droplet discharged by the liquid discharge device will be constant.

Furthermore, the inventor has confirmed that when the supply liquid pressure is set within the stable range, the flying speed of the droplet will remain constant and the liquid will not inadvertently leak from the discharge hole even if there is a slight difference in the control timing by the supply control unit and the actuation control unit.

Furthermore, the liquid discharge device may include a negative pressurizing unit configured to apply a negative pressure to the liquid in the storage chamber to equalize a pressure of the liquid with the atmospheric pressure.

With this, since the pressure of the liquid in the storage chamber (including the discharge hole) after supply of the liquid can be made a constant value (for example, atmospheric pressure or in the vicinity thereof), it is possible to maintain the state of the surface of the liquid (the state of the convex or concave surface of the liquid inside a tube, caused by surface tension, that is, meniscus) and the position of the surface of the liquid inside the discharge hole (or in the vicinity of the outer edge of the opening of the discharge hole) at a constant level.

This is particularly advantageous in a situation in which the pressure inside the storage chamber fluctuates as a result of the height of the surface of the liquid to be supplied, such as when the supply source is positioned higher than the opening of the discharge hole, or in a situation in which a variation occurs in the atmospheric pressure in the area of the liquid discharge device.

Furthermore, the liquid discharge device may include a supply source including a syringe and a plunger, the supply source holding, in the syringe, the liquid to be supplied to the storage chamber, wherein the plunger includes a flexible portion that is flexible in a moving direction of the plunger, the syringe includes a sealed pressure regulating chamber on a side of the plunger opposite to a holding chamber which holds the liquid, and the negative pressurizing unit may be configured to apply a negative pressure to the liquid by transporting gas from inside the pressure regulating chamber to outside the pressure regulating chamber.

With this, it is possible to avoid complications in accurately adjusting the pressure of the liquid due to the frictional resistance between the plunger and the syringe when making the pressure of the liquid equal to or in the vicinity of the atmospheric pressure by causing the negative pressurizing unit to adjust the pressure inside the pressure regulating chamber.

That is to say, since the flexible portion included in the plunger flexes with the change in pressure in the pressure regulating chamber irrespective of frictional resistance between the plunger and the syringe, the pressure inside the pressure regulating chamber acts directly on the liquid, and the pressure of the liquid can be accurately adjusted.

In this sense, it is preferable that the flexible portion flex under a force less than the force of the frictional resistance between the plunger and the syringe.

Moreover, in order to achieve the above-describe objective, a liquid discharge method for discharging a liquid as a droplet using a discharge unit including: an elastic discharge part including a storage chamber at least partially formed of an elastic component, a supply hole which leads to the storage chamber and through which the liquid is supplied to the storage chamber, and a discharge hole through which the liquid stored in the storage chamber is discharged; and an actuating unit which varies a volumetric capacity of the storage chamber, the liquid discharge method including: pressurizing the liquid to be supplied to the storage chamber to a pressure within a stable range; controlling whether the pressurized liquid is supplied to the storage chamber using the supply control unit; and discharging the liquid by controlling operation of the actuating unit using the actuation control unit.

Consequently, it is possible to discharge an accurate amount of liquid regardless of the viscosity and discharge liquid at high speed while reducing factors that adversely accuracy.

It is to be noted that implementation of the present invention as a computer program for causing a computer to execute each process included in the liquid discharge method is intended to be included in an embodiment of the present invention. A non-transitory computer-readable recording medium for use in a computer containing said program is also intended to be included in an embodiment of the present invention.

Advantageous Effects of Invention

With the present invention, it is possible to discharge a wide variety of liquids, discharge an accurate amount of liquid, and discharge liquid at high speed.

DESCRIPTION OF EMBODIMENTS

Next, an embodiment of the liquid discharge device and liquid discharge method according to the present invention will be discussed with reference to the Drawings. It is to be noted that the following embodiments are merely an example of the liquid discharge device and liquid discharge method according to the present invention. As such, the scope of the present invention is demarcated by the scope of the language in the Claims using the below embodiments as a reference, and is not intended to be limited merely by the following embodiments.

Figure 1:
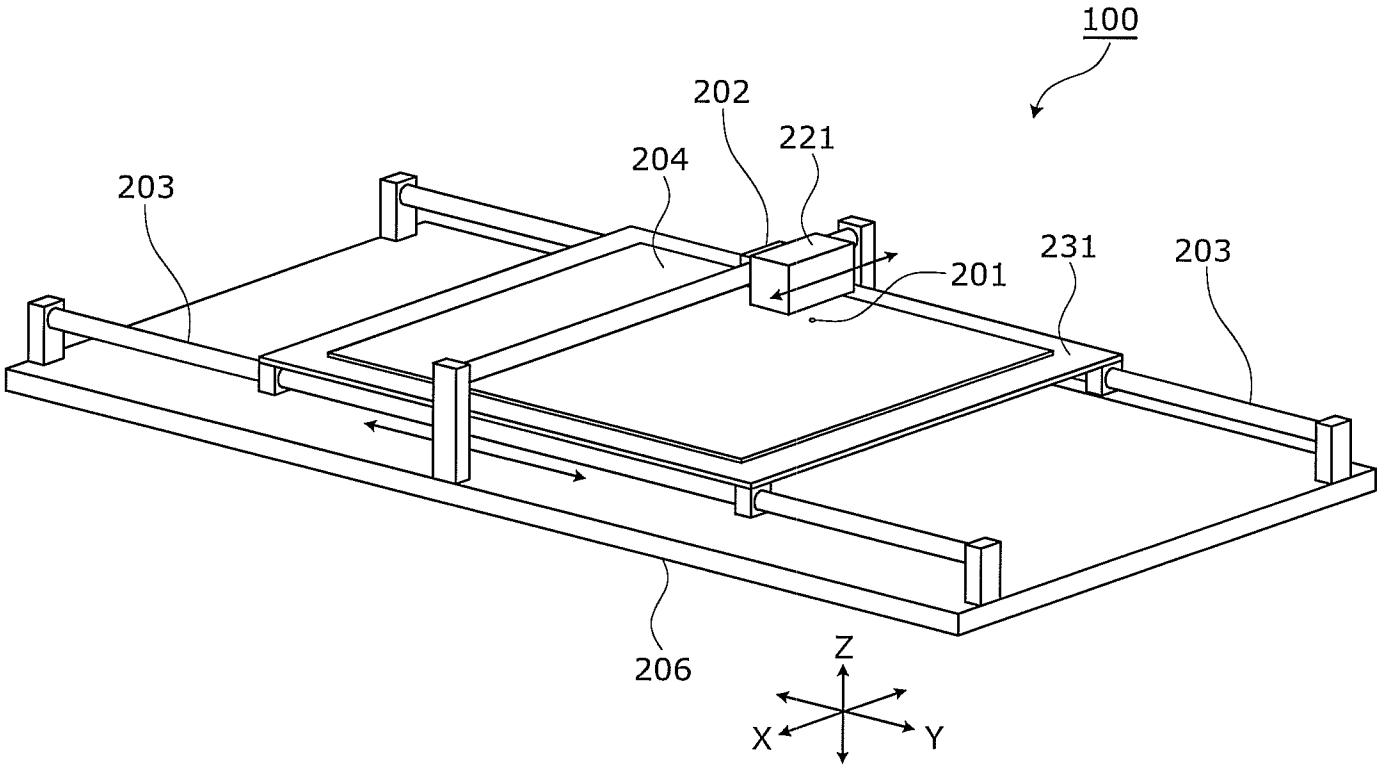
FIG. 1 is a perspective view of the liquid discharge device framework.

FIG. 1 is a perspective view of the liquid discharge device framework.

A liquid discharge device 100 according to this embodiment is a device which can form a pattern by discharging a liquid 201 onto a desired location on an object to be coated 204, and includes a head 221 and a stage 231 which holds the object to be coated 204.

The head 221 is provided with one or more discharge units 101 (to be described later), and reciprocates in a main scanning direction (x axis direction in FIG. 1) along a head transporter 202 supported by a work base 206. The stage 231 similarly reciprocates in a vertical scanning direction (y axis direction in FIG. 1) along a stage transporter 203 supported by the work base 206.

With this configuration, the liquid discharge device 100 discharges the liquid 201 in a direction facing the object to be coated 204 from the discharge unit 101 which includes the head 221 while relatively moving the head 221 and the object to be coated 204 secured above the stage 231 to form a desired pattern or a uniform film on the object to be coated 204.

Figure 2:
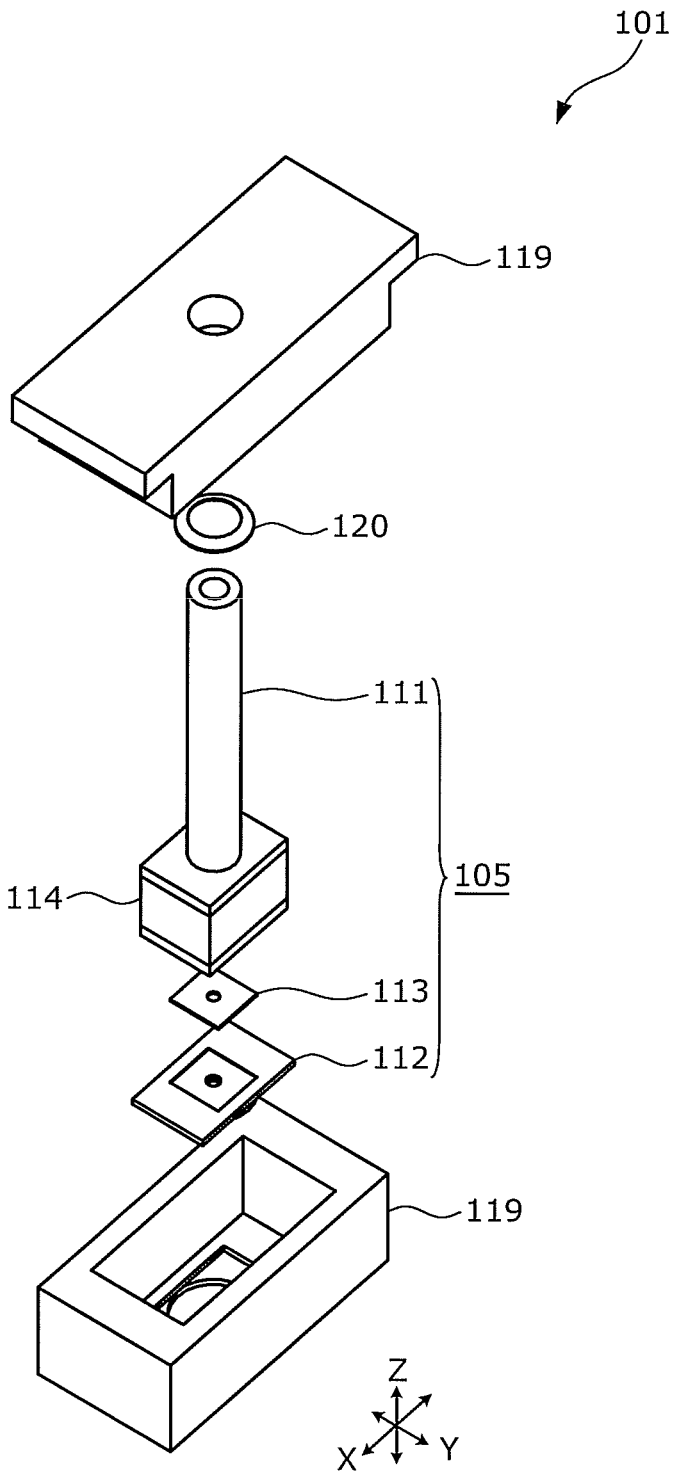
FIG. 2 is a perspective exploded view illustrating the framework of the parts of the liquid discharge device related to the discharging of liquid.

FIG. 2 is a perspective exploded view illustrating the framework of the parts of the liquid discharge device related to the discharging of liquid.

Figure 3:
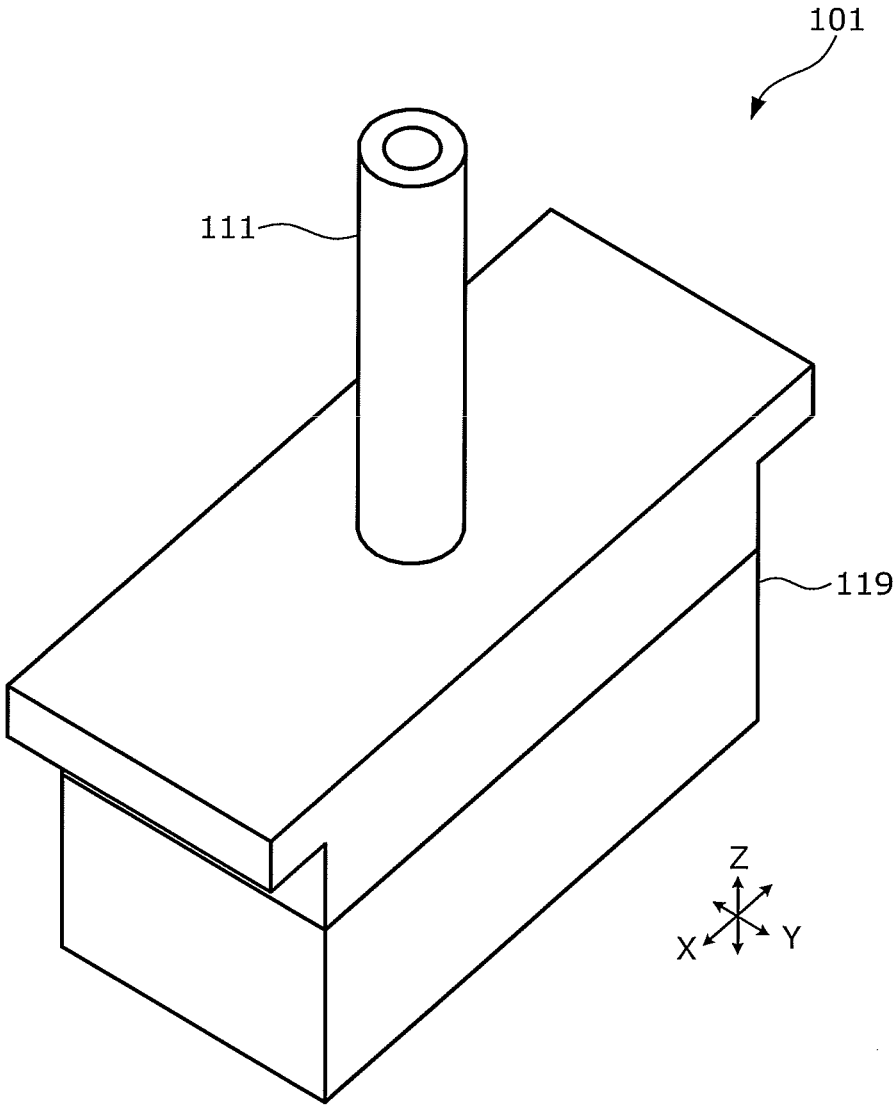
FIG. 3 is a perspective external view illustrating the framework of the parts of the liquid discharge device related to the discharging of liquid.

FIG. 3 is a perspective external view illustrating the framework of the parts of the liquid discharge device related to the discharging of liquid.

Figure 4:
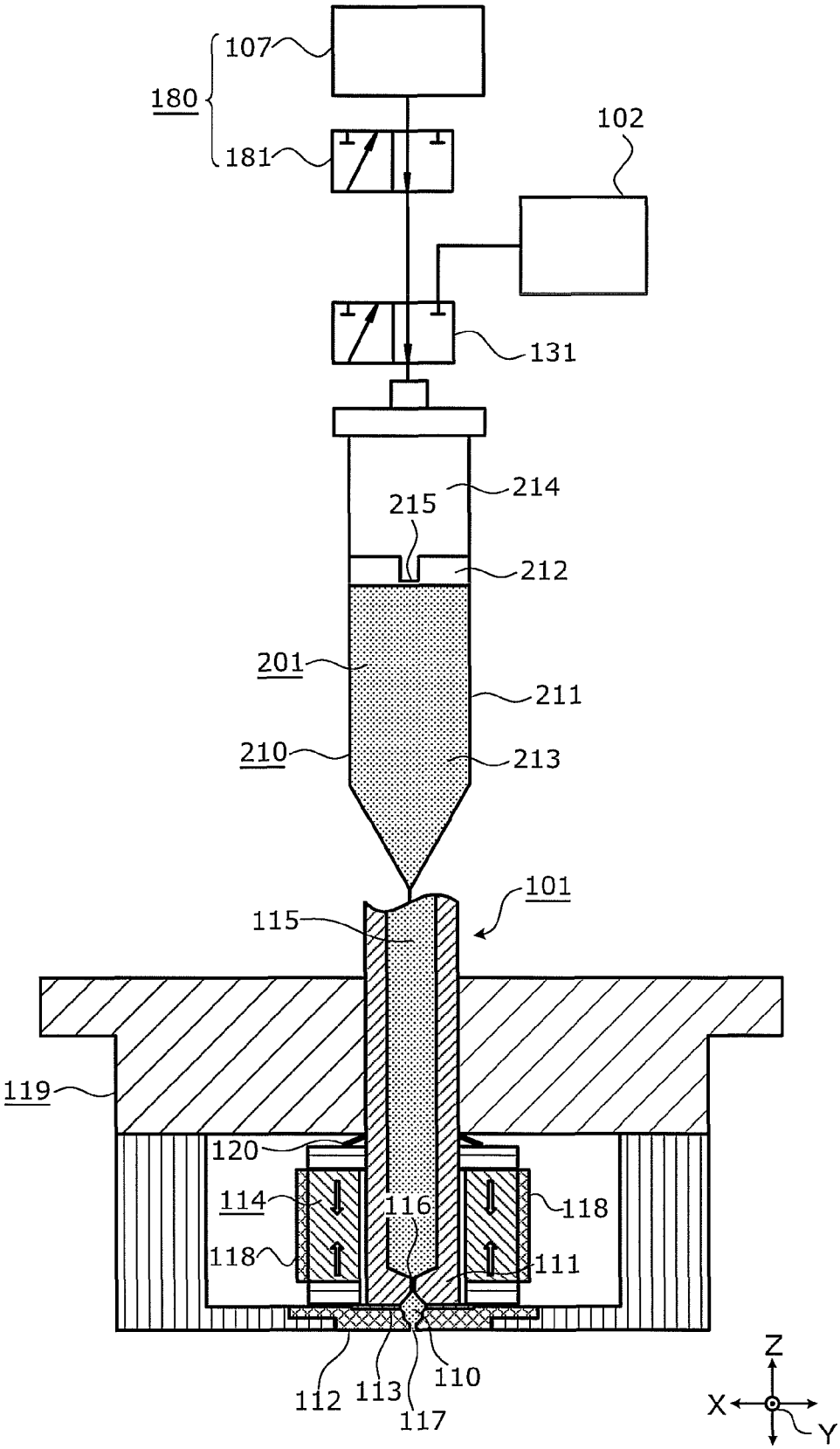
FIG. 4 illustrates a partial cross-section of the framework of the parts of the liquid discharge device related to the discharging of liquid.

FIG. 4 illustrates a partial cross-section of the framework of the parts of the liquid discharge device related to the discharging of liquid.

Figure 5:
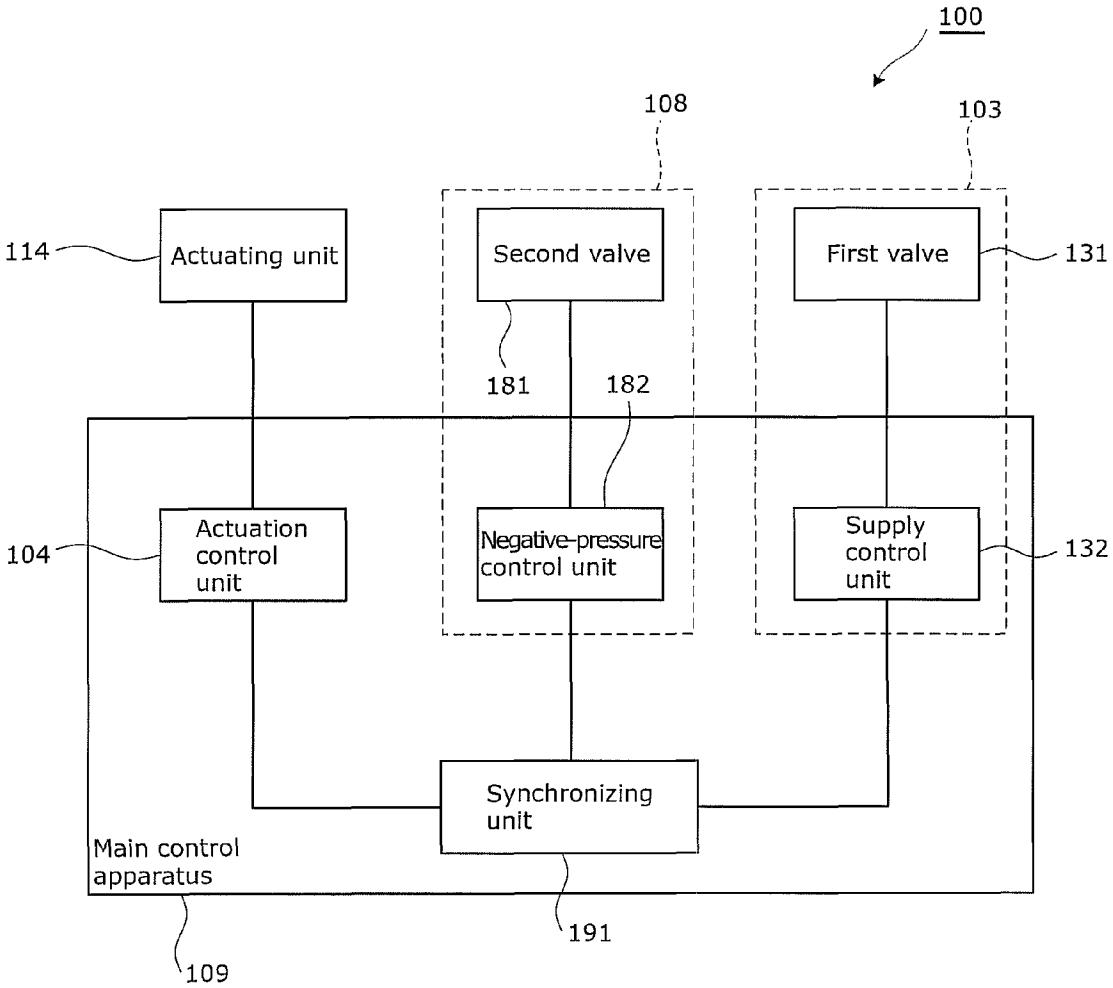
FIG. 5 is a block diagram showing the functional configuration of the parts of the liquid discharge device related to the discharging of liquid.

FIG. 5 is a block diagram showing the functional configuration of the parts of the liquid discharge device related to the discharging of liquid.

As is shown in these Drawings, the liquid discharge device 100 is a device which can discharge no more or less than a given amount of a desired liquid 201 as a droplet, and includes the discharge unit 101, a pressurizing unit 102, a supply control unit 103, an actuation control unit 104, and a supply source 210.

The discharge unit 101 includes an elastic discharge part 105 and an actuating unit 114, and can discharge the liquid 201 filling a storage chamber 110, which is formed inside the elastic discharge part 105, as a droplet by reducing the volumetric capacity of the storage chamber 110 for a short period of time. In this embodiment, the elastic discharge part 105 includes a first component 111, a second component 112, and an elastic component 113.

The first component 111 is a part of the elastic discharge part 105, and forms part of the storage chamber 110. The first component 111 is a tube which functions as a supply path 115 for the liquid 201. An indented portion having a conical shape (tapered shape) is formed at a tip portion of the first component 111, the surface area of which gradually increases in a direction towards the tip surface (the end towards the second component 112 in the z axis direction). The indented portion forms one portion (one component) of the storage chamber 110. Moreover, a supply hole 116, which is an orifice which opens to the supply path 115 and the storage chamber 110, is provided at a portion corresponding to the apex of the conical indented portion. The first component 111 is a component which compresses the elastic component 113 with the second component 112, and compared to the elastic component 113, is made of a highly rigid material. The first component 111 is, for example, made of stainless steel.

The second component 112 forms another portion (other component) of the storage chamber 110, and provides a discharge hole 117 for discharging the liquid 201 in the storage chamber 110. In this embodiment, the second component 112 is provided with an indented portion having a tapered shape whose surface area gradually increases in a direction from the discharge hole 117 towards the first component 111. The storage chamber 110 is formed by positioning the indented portion of the first component 111 and the indented portion of the second component 112 to face each other. The second component 112 is a component which compresses the elastic component 113 with the first component 111, and compared to the elastic component 113, is made of a highly rigid material. The second component 112 is, for example, made of stainless steel.

The elastic component 113 is disposed between the first component 111 and the second component 112 and provided for varying the volumetric capacity of the storage chamber 110. In this embodiment, the elastic component 113 is formed in the shape of a thin plate, and a portion of the elastic component 113 that is sandwiched between the two indented portions (that is, between the first component 111 and the second component 112) is provided with a through hole extending in a thickness direction (z axis direction) shaped to correspond with the two indented portions. In detail, the elastic component 113 is formed of fluorine rubber or silicone rubber, for example, and has an elastic characteristic that allows for the distance between the first component 111 and the second component 112 to be reduced by the actuating unit 114, a sealing characteristic that allows for the prevention of leaking from the surface between the first component 111 and the second component 112 forming the storage chamber 110, the strength to resist the pressure of the liquid 201 in the storage chamber 110, and a shape restoration characteristic that allows for the discharging of the liquid 201 to occur multiple times. Moreover, the function of the elastic component 113 is not based in these material properties alone, but also in the shape (for example, ring shaped in the XY plane) of the elastic component 113. For example, by forming the elastic component 113 to have a thickness between 100 μm and 300 μm (inclusive), preferably in the shape of a thin plate approximately 200 μm thick centrally provided with a loop-shaped component having through hole in a thickness direction with an inner diameter of approximately 1000 μm, the elastic component 113 realizes its function interdependently of its material properties.

It is to be noted that the size (volumetric capacity) and shape of the storage chamber 110, the supply hole 116, and the discharge hole 117 can be designed to suit the type of liquid 201 to be discharged and the volume of the droplet to be discharged. For example, when the cubic volume of the discharged droplet is a few nanoliters (for example, 3 nl), the discharge hole 117 is 85 μm in diameter and approximately 70 μm in length, the vicinity of the elastic component 113 in the storage chamber 110 is a cylindrical shape approximately 1000 μm in diameter, the supply hole 116 is 110 μm in diameter and approximately 700 μm in length. Moreover, when the cubic volume of the discharged droplet is several nl (for example, 20 nl), the discharge hole 117 is 100 μm in diameter and approximately 100 μm in length, and the vicinity of the elastic component 113 in the storage chamber 110 is a cylindrical shape approximately 1500 μm in diameter.

Here, the supply hole 116 (orifice) which supplies the liquid 201, the storage chamber 110, and the discharge hole 117 are positioned in a straight line to reduce resistance to the liquid 201. This makes it easier to rapidly fill the storage chamber 110 and the discharge hole 117 with the liquid 201.

Moreover, at least one of the first component 111 and the second component 112 (second component 112 in this embodiment) is provided with a recessed portion in which the elastic component 113 is fitted to box in the outer surface of the elastic component 113. This restricts the elastic component 113 from deforming outward with respect to the storage chamber 110 when elastic deformation of the elastic component 113 occurs in the thickness direction. This is to keep the pressure of the liquid 201 inside the storage chamber 110 from decreasing as a result of the elastic component 113 expanding in an intersecting direction of the thickness direction thereof.

Figure 6:
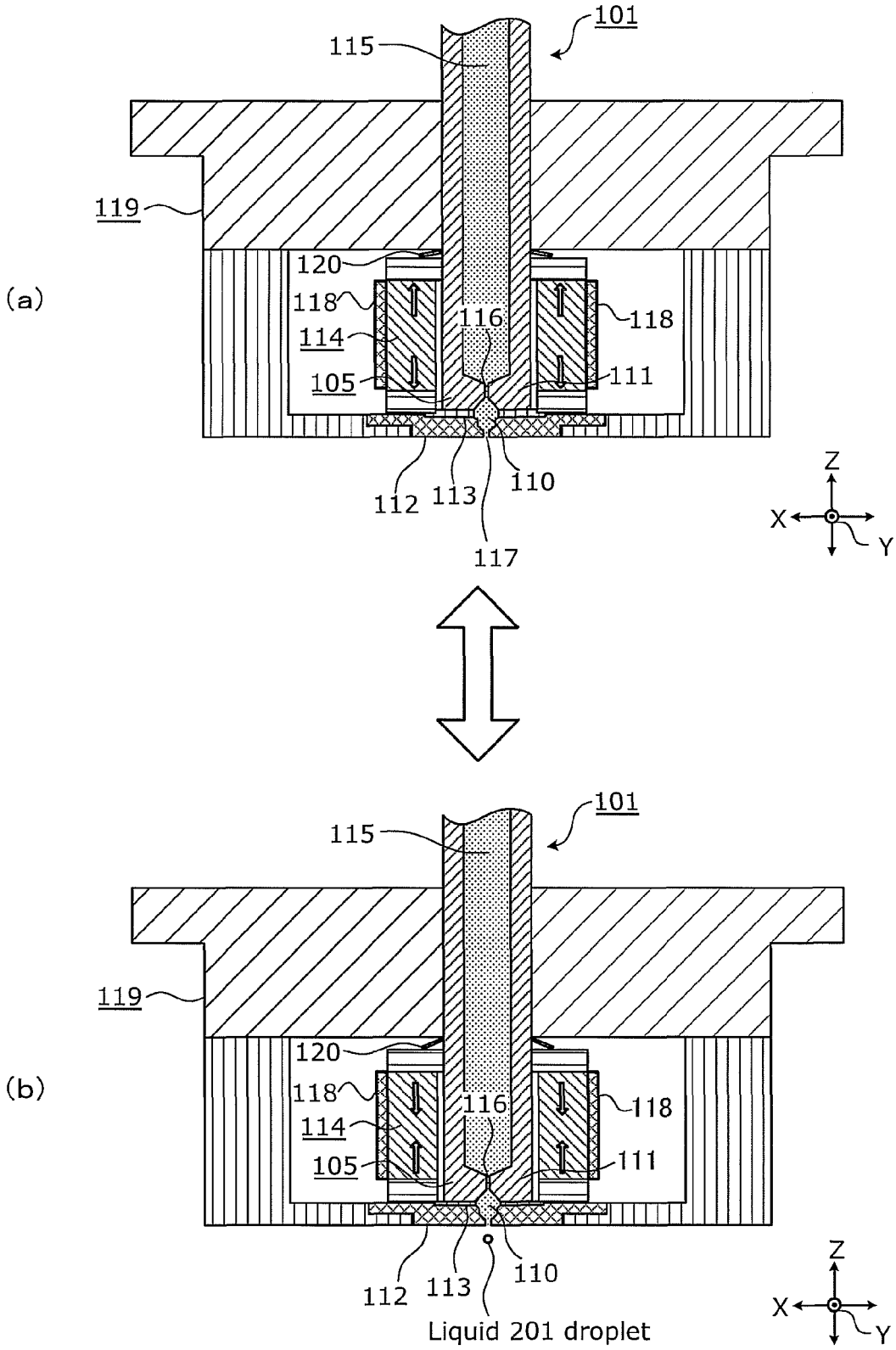
FIG. 6 is a cross-sectional view illustrating a liquid discharging operation of the discharge unit when in (a) a pre-discharge state and (b) a post-discharge state.

The actuating unit 114 is an actuator which exerts power to extend the storage chamber 110 in the z axis direction and increase the volumetric capacity thereof (see FIG. 6 (*a*)) under normal circumstances (a normal basis in which supply of the liquid 201 to the storage chamber 110 is possible), and exerts power to relatively reduce the distance between the first component 111 and the second component 112 (see FIG. 6 (*b*)) by compressing the elastic component 113 and reducing the volumetric capacity of the storage chamber 110 in order to discharge the liquid 201. Here, a unit which operates the first component 111 and the second component using air pressure or magnetism can be used as the actuating unit 114, but taking into consideration the size of the apparatus and responsivity, a piezoelectric element is preferable. In particular, a stacked piezoelectric body is preferable for the actuating unit 114. In this embodiment, one end (upper end) of the actuating unit 114 in the lengthwise direction (z axis direction) is rigidly connected to the outer surface of the first component 111 with an adhesive, and the other end (lower end) is connected to a portion of the second component 112 via the elastic component 113. Under voltage supply, the actuating unit 114 exerts power to extend the distance between the first component 111 and the second component 112 in the lengthwise direction (z axis direction). It is to be noted that in this embodiment, the other end (lower end) of the actuating unit 114 is connected to a portion of the second component 112 supported by a housing 119 (to be described later) via the elastic component 113, and is not rigidly connected using an adhesive, for example.

It is to be noted that the portion in which the other end (lower end) of the actuating unit 114 and a portion of the second component 112 are in direct contact may be fixed together with an adhesive in order to prevent the relative follow-up timing of the second component 112 from being off in the z axis direction with respect to the other end (lower end) of the actuating unit 114 when the actuating unit 114 contracts in the z axis direction (in order to ensure stable discharge of the liquid 201 droplet and prevent leaking between the contact surfaces of the other end (lower end) of the actuating unit 114 and the second component). This configuration is, however, not intended to be limiting. For example, a fixed configuration of a separable, mechanical structure achieved by increasing the elastic force (biasing force) of the biasing unit 120 is acceptable.

Specifically, the actuating unit 114 expands in the z axis direction, as is shown in FIG. 6 (*a*), as a result of voltage being applied to an electrode 118, and contracts in the z axis direction, as is shown in FIG. 6 (*b*), as a result of releasing the application of voltage, thereby causing the discharge of the liquid 201.

Moreover, the stacked piezoelectric body used as the actuating unit 114 is arranged to encompass the perimeter of the cylindrical first component 111. That is, the stacked piezoelectric body used as the actuating unit 114 is provided with a through-hole in which the first component 111 can be inserted with room to maneuver. By forming the actuating unit 114 to have this kind of shape, the elastic component 113 interposed between the first component 111 and the second component 112 can contract and expand relatively uniformly in the z axis direction.

In this embodiment, the discharge unit 101 is further provided with the housing 119 and the biasing unit 120.

The housing 119 is a separable structure arranged to sandwich the elastic component 113 between the second component 112 and the actuating unit 114 as well as the first component 111 rigidly connected to the actuating unit 114.

The biasing unit 120 has a biasing force in a direction pushing the actuating unit 114 into the second component 112 via the housing 119. In this embodiment, the biasing unit 120 is a disc spring.

Since, for example, by taking apart the housing 119 it is possible to separate the first component 111 from the actuating unit 114 and the actuating unit 114 from the second component 112, and possible to easily exchange or clean the second component 112 when the discharge hole 117 is clogged, the maintenance capability of the discharge unit 101 is improved with this kind of structure. Moreover, by preparing multiple second components 112 having different discharge holes 117 and indented portions, the second component 112 can be easily changed out to suit the type of liquid 201 to be used.

Furthermore, since the elastic component 113 is also separable it can easily be changed out in the case of deterioration, for example, thereby improving the longevity of the discharge unit 101 as a whole.

The supply source 210 holds the liquid 201 to be supplied to the storage chamber 110, and in the case of this embodiment, includes a syringe 211 and a plunger 212.

The syringe 211 is a cylindrical container which holds the liquid 201 internally, and can supply the liquid 201 to the storage chamber 110 at a constant pressure by moving the plunger 212. The syringe 211 includes a holding chamber 213 which holds the liquid 201, and a sealed pressure regulating chamber 214 on a side of the plunger 212 opposite to the holding chamber 213.

The plunger 212 is positioned inside the syringe 211 to slide independently of the syringe 211 and is a piston which can push out the liquid 201 from inside the syringe 211. In this embodiment, a flexible portion 215, which is flexible in the direction in which the plunger 212 slides, is provided in a portion of the plunger 212. In this embodiment, the flexible portion 215 is a film which blocks one end of a hole penetrating the plunger 212 in the direction in which the plunger 212 slides.

It is to be noted that the entire plunger 212 itself may be flexible and function as the flexible portion 215.

The above-described aspect of the supply source 210 is preferable because, compared to a pump, for instance, pulsation does not occur.

The pressurizing unit 102 pressurizes the liquid 201 to be supplied to the storage chamber 110 to a pressure greater than the atmospheric pressure. In this embodiment, since the supply source 210 is configured of the syringe 211 and the plunger 212, the pressurizing unit 102 can inject pressurized air into the pressure regulating chamber 214 of the supply source 210. By injecting pressurized air into the pressure regulating chamber 214, the pressurizing unit 102 can move the plunger 212 relative to the syringe 211 and pressurize the liquid 201.

It is to be noted that the pressurizing unit 102 is not limited to a device such as an air compressor which generates pressurized air, but may be a device which mechanically moves the plunger 212 relative to the syringe 211, such as a device using a biasing unit such as a spring to apply a constant force to the plunger 212. The pressurizing unit 102 may also be a pump having the functions of the pressurizing unit 102 that can pressurize and supply the liquid 201 at the same time, such as a tube pump, for example. Moreover, an industrial air source, such as one found in a manufacturing facility, may also be used.

Furthermore, when the liquid 201 does not include a volatile element, the pressurizing unit 102 may be a device which supplies the liquid 201 to the storage chamber 110 of the elastic discharge part 105 by directly pressurizing the liquid 201 with air, for example, without the use of a plunger.

The supply control unit 103 controls whether or not the pressurized liquid 201 is supplied to the storage chamber 110. In this embodiment, the supply control unit 103 includes a first valve 131 and a supply control unit 132 (see FIG. 4 and FIG. 5).

The first valve 131 is provided along an air pathway connecting the pressurizing unit 102 (air compressor, industrial air source, etc.) and the pressure regulating chamber 214, and controls whether to let in or block pressured air to the pressure regulating chamber 214 by opening or closing, respectively.

In this embodiment, the first valve 131 is a three-port valve (see FIG. 4). That is to say, when the first valve 131 is closed, pressurized air from the pressurizing unit 102 is blocked from being supplied to the pressure regulating chamber 214 and the pressure regulating chamber 214 is switched to open to a different path. The "different path" is a path connected to a second valve 181 (to be described later). Furthermore, the second valve 181 is a three-port valve just like the first valve 131 is, and can selectively connect to a negative-pressure source 107 (to be described later), the atmosphere, and the different path. It is to be noted that the different path may simply be a path that opens to the atmospheric pressure.

With the above configuration, when the air path is switched from being open to the pressurizing unit 102 to being open to the negative-pressure source 107, the path between the pressure regulating chamber 214 and the negative-pressure source 107 is open. Here, when the first valve switches to the different path, it is possible to reduce (remove) residual pressure in the pressure regulating chamber 214 pressurized by the pressurizing unit 102 in a minimal amount of time by opening the pressure regulating chamber 214 to the atmospheric pressure using the second valve 181. Here, "minimal amount of time" is between 10 and 20 msec (not shown in FIG. 7 or FIG. 9). With this, the pressure added to the liquid 201 is stopped and the supply of the liquid to the storage chamber 110 is stopped.

The supply control unit 132 is a processing unit realized from a main control apparatus 109, such as a computer, included in the liquid discharge device 100, and controls the opening and closing of the first valve 131.

It is to be noted that when the pressurizing unit 102 is, for example, a pump, the supply control unit 103 may control the supply of the liquid 201 by controlling the operation and non-operation of the pump instead of controlling the supply of the liquid 201 by opening and closing the valve.

The actuation control unit 104 is a processing unit which controls the actuating unit 114. In this embodiment, since the actuating unit 114 is made of a piezoelectric element, the operation of the actuating unit 114 is controlled by controlling the application of voltage to two electrodes 118 included in the actuating unit 114. It is to be noted that the actuation control unit 104 may control the operation of the actuating unit 114 by adjusting the voltage applied to the actuating unit 114.

Moreover, in this embodiment, as FIG. 4 and FIG. 5 show, the liquid discharge device 100 includes the negative pressurizing unit 180, and the main control apparatus 109 includes a synchronizing unit 191. In this embodiment, the negative pressurizing unit 180 includes the negative-pressure source 107 and a negative-pressure supply control unit 108.

the negative pressurizing unit 180 applies negative pressure to the liquid 201 in the storage chamber 110 to provide pressure equalization between the liquid 201 and the atmosphere. For example, when the supply source 210 is configured of the syringe 211 and the plunger 212, such as the case with this embodiment, the negative-pressure source 107 can expel a gas (air) from the pressure regulating chamber 214 in the supply source 210 (such as an exhaust pump, a vacuum pump, an industrial vacuum, or a vacuum tank). Moreover, the negative-pressure source 107 may be the atmosphere (may be exposed to the atmosphere by an open end). Moreover, the negative-pressure supply control unit 108 includes the second valve 181 and a negative-pressure control unit 182. As described above, the negative-pressure supply control unit 108 controls the second valve 181 via the negative-pressure control unit 182 to make the path between the negative-pressure source 107 and the pressure regulating chamber 214 open and expel the gas from the pressure regulating chamber 214: This makes it possible to equalize the pressure of the liquid 201 with the atmospheric pressure, which is the pressure of the gas outside the syringe 211 and the storage chamber 110.

It is to be noted that here (see FIG. 4), the path between the negative-pressure source 107 and the pressure regulating chamber 214 can be opened via both the first valve 131 and the second valve 181, but the present invention is not limited to this configuration. The pressure regulating chamber 214 may be opened to via each of the first valve 131 and the second valve 181, for example. In this case, the first valve 131 and the second valve 181 do not need to be three-port valves. However, with this configuration, the pressurizing unit 102 and the negative-pressure source 107 cannot be open to the pressure regulating chamber 214 at the same time, and caution must be given with regard to keeping the control of the pressure regulating chamber 214 from becoming unstable.

With this, it is possible to proactively keep the pressure of the liquid inside the storage chamber 110 and the discharge hole 117 at a constant valve (for example, atmospheric pressure or a value in the vicinity thereof), and possible to maintain a constant position (height) of the surface of the liquid and meniscus. Consequently, the cubic volume of the liquid 201 held in the storage chamber 110 and the discharge hole 117 can be kept constant, making it possible to achieve an extremely accurate discharge volume in which droplets of the liquid 201 are discharged having a constant volume (cubic volume).

With this embodiment in particular, since the plunger 212 includes the flexible portion 215, even a slight change in pressure in the pressure regulating chamber 214 can be acutely translated to the liquid 201, making it possible to finely adjust the pressure of the liquid 201 to equalize it with the atmospheric pressure.

It is to be noted that there are instances in which it is acceptable that the negative pressurizing unit 180 does not include a negative-pressure source 107 which actively discharges the gas from the pressure regulating chamber 114, such as a vacuum pump. For example, the negative pressurizing unit 180 may be an apparatus which can change the position of the height of the supply source 210 and adjust the heightwise (z axis direction) positional relationship between the storage chamber 110 and the surface of the liquid 201 stored in the supply source 210, and equalizes the pressure of the liquid 201 in the storage chamber 110 with the atmospheric pressure by, for example, lowering the surface of the liquid 201 stored in the supply source 210 to a height lower than the storage chamber 110 to keep the hydraulic head pressure of the liquid 201 in the supply source 210 applied to the storage chamber 110 from exceeding the necessary amount.

The synchronizing unit 191 is a processing unit which adjusts the discharge timing of the liquid 201 from the discharge hole 117 in the elastic discharge part 105 and the supply timing of the pressurized liquid 201 to the storage chamber 110 by receiving information from each of the actuation control unit 104 and the supply control unit 132. In this embodiment, the synchronizing unit 191 also adjusts the negative pressure application timing by receiving information between the negative-pressure control unit 182 as well.

Next, the operation of the above-described liquid discharge device 100 will be explained.

Figure 7:
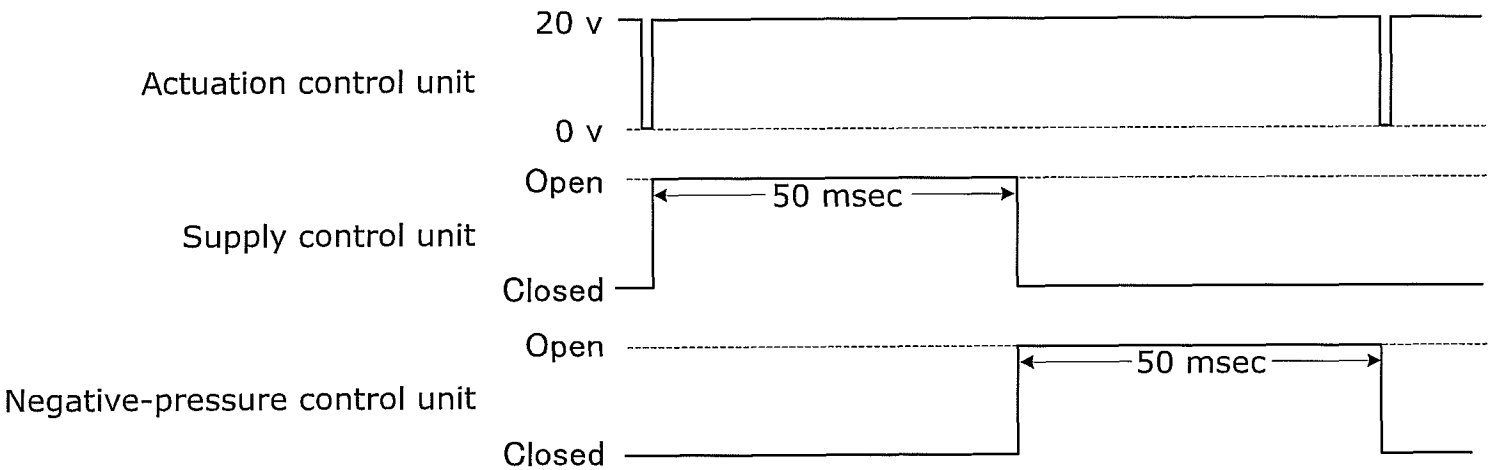
FIG. 7 is a timing chart showing shifts in operations of the liquid discharge device.

FIG. 7 is a timing chart showing shifts in operations of the liquid discharge device.

First, the actuation control unit 104 causes the actuating unit 114 to extend in the z axis direction and increase the volumetric capacity of the storage chamber 110 (see FIG. 6 (*a*)) by applying a predetermined voltage (for example, 20 V) to the actuating unit 114. Next, the actuation control unit 104 fills the discharge hole 117 and the increased volumetric capacity storage chamber 110 with the liquid 201 via the supply hole 116, whose channel diameter is temporarily narrowed just before the liquid 201 enters the storage chamber 110, which is the supply mouth for the liquid 201. Next, the actuation control unit 104 releases the voltage applied to the actuating unit 114 for an extremely short period of time (for example, between 10 μsec and 10 msec). This causes the actuating unit 114 to contract for an instant in the z axis direction (the condition shown in FIG. 6 (*b*)).

Since the first component 111 and the second component 112 deform such that their relative positions become closer together a result of the upper portion of the actuating unit 114 being connected to the first component 111 in a fixed manner and the contraction of the actuating unit 114 being pressed towards the second component 112 by the biasing unit 120, the elastic component 113 sandwiched between the first component 111 and the second component 112 deforms and contracts, thereby relatively reducing the space in the storage chamber 110 in the z axis direction and applying pressure to the liquid 201 in the storage chamber 110.

With this, the liquid 201 is discharged toward the object to be coated 204 as a droplet from the discharge hole 117, which has lower back pressure resistance (discharge resistance on the discharge hole 117 side) than the supply hole 116 which is the supply mouth for the liquid 201 in the storage chamber 110. The droplet adheres as a dot to the upper surface of the object to be coated 204.

Next, the first valve 131 is opened by the supply control unit 132 in order to supply the liquid 201 to the storage chamber 110 as a result of the synchronizing unit 191 transmitting, to the supply control unit 132, information on the voltage applied to the actuating unit 114 by the actuation control unit 104.

With this, the pressurized liquid 201 travels from the supply source 210 and passes through the supply path 115 of the first component 111, and fills the storage chamber 110 rapidly and without comprising accuracy via the supply hole 116 smaller in diameter than the supply path 115 and the storage chamber 110. It is to be noted that at this point, the first component 111 has shifted due to the actuating unit 114 expanding in the z axis direction as a result of a voltage application thereto, causing the space in the storage chamber 110 in the z axis direction to expand, returning the storage chamber 110 its original state (original volumetric capacity).

The supply control unit 132 accurately controls the length of time that the first valve 131, which is a positive pressure valve that pressure supplies the liquid 201 to the storage chamber 110, remains open. For example, when the cubic volume of the discharged droplet of the liquid 201 is a few nanoliters, the first valve 131 is made to remain open for approximately 50 msec.

Here, the pressure applied to the liquid by the pressurizing unit 102 may be a pressure selected from a stable range. The stable range is a range of the air pressure injected into the pressure regulating chamber 214 by the pressurizing unit 201. The stable range differs depending on the amount of the liquid 102 discharged and the size and shape of the storage chamber 110 and the discharge hole 117. For example, when the cubic volume of the discharged droplet of the liquid 201 is a few nanoliters, the stable range is between 10 kPa and 30 kPa, inclusive.

Figure 8:
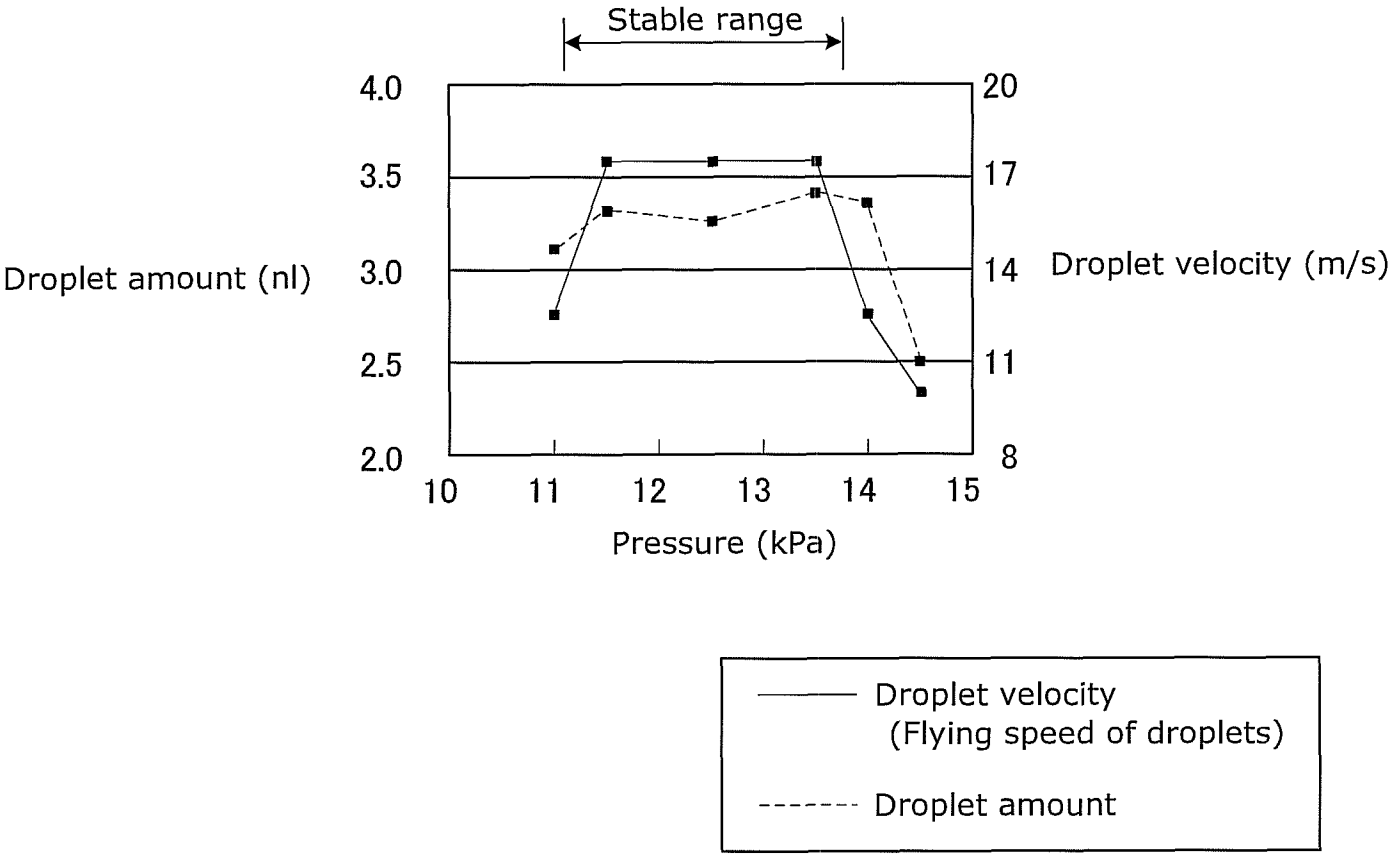
FIG. 8 is a graph illustrating an example of actual experiment results.

Moreover, a fixed stable range for the liquid discharge device 100 can be determined with the following experimental test. An average speed (droplet flying speed) and a volume of the discharged liquid 201 droplet in a predetermined period can be measured by changing the supply pressure of the liquid 201 via the pressurizing unit 102 in multiple stages and discharging the liquid 201 in each of the stages, as FIG. 8 shows. As a result, even if the supply pressure which supplies the liquid to the storage chamber 110 is changed, a range can be selected in which the speed and volume of the droplet does not greatly vary. This range may be set as the stable range.

Similarly, regarding the supply time of the liquid 201 to the storage chamber 110 and the discharge hole 117, in this embodiment, the amount of time that the supply control unit 132 keeps the first valve 131 open can be set in advance. For example, an average speed and a volume of the discharged liquid 201 droplet in a predetermined period can be measured by changing the supply time in multiple stages and discharging the liquid 201 in each of the stages. As a result, even if the supply time is changed, a range can be selected in which the speed and volume of the droplet does not greatly vary. This range may also be set as the stable range for the supply time. Consequently, a shorter time from the stable range may be selected when one wishes to increase the discharge cycle of the liquid 201.

Next, the second valve 181 is opened by the negative-pressure control unit 182 as a result of the synchronizing unit 191 transmitting, to the negative-pressure control unit 182, information regarding the ending of the opening of the first valve 131 (the closing of the first valve 131) by the supply control unit 132. With this, the liquid 201 filling the storage chamber 110 and the discharge hole 117 is drawn into a stable condition by negative pressure. That is to say, the state of the meniscus, which is the surface made by the liquid 201 in the narrow tube (discharge hole 117), is stabilized due to the surface tension of the liquid 201 in the discharge hole 117, and the amount of the liquid 201 filling the storage chamber 110 and the discharge hole 117 is stabilized. With this, leakage of the liquid 201 from the discharge hole 117 can be kept under control.

By the actuation control unit 104 once again releasing the application of the voltage to the piezoelectric element configured of the actuating unit 114 and shrinking the actuating unit 114, it is possible to once again discharge a droplet of approximately the same volume that was previously discharged.

Here, "approximately the same volume" refers to within a margin of error of 1% when the volume of the discharged droplet is a few nanoliters. At this point in time, the margin of error for the droplet volume is smaller than can actually be measured, and is believed to be 0.01% or less. As a comparison, the droplet volume margin of error in a conventional apparatus is approximately 3%.

It is to be noted that in FIG. 7, while the second valve 181 is set to be open for an interval of 50 msec, the time is not intended to be limited thereto. In the case that one wishes to shorten the discharge cycle, the interval time may be shortened.

With this, after discharge of the liquid 201, the storage chamber 110 and the discharge hole 117 can be filled in an extremely short period of time (in milliseconds or a lower magnitude of order) by supplying the liquid 201 pressurized to within the stable range. Moreover, since the stable range is sufficiently high relative to the atmospheric pressure, the storage chamber 110 and the discharge hole 117 can be filled with a constant amount of the liquid 201 each time, even if the atmospheric pressure were to change.

Consequently, the discharge cycle, which is the span that the liquid 201 is discharged, can be shortened and a large number of droplets of the liquid 201 can be discharged in a short period of time. Moreover, since the amount of the liquid 201 up to the discharge hole 117 is a stabilized amount, the amount of liquid 201 discharged is a constant amount, and the object to be coated 204 can be coated with an accurate amount of the liquid 201.

Furthermore, with the above-described pressurized supply of the liquid 201, it is possible to rapidly fill the storage chamber 110 and the discharge hole 117 with the liquid 201 while reducing factors that adversely accuracy. As such, it is possible to increase the capacity of the storage chamber 110 and the discharge hole 117, supply the liquid 201 while controlling the pressurized supply so that the condition of the meniscus remains stable in the discharge hole 117, and discharge the liquid 201 pressurized by the actuating unit 114. In turn, this makes it possible to accurately discharge an even larger amount of the liquid.

Moreover, since the discharge unit 101 does not include components having rigid parts which slide or come into contact with the parts through with the liquid 201 passes, the liquid 201 can be discharged in a stable manner even when it contains solid matter dispersed therein.

It is to be noted that the present invention is not limited to the above embodiment. For example, embodiments resulting from arbitrary combinations of constituent elements recited in the present invention or embodiments in which some constituent elements are left out may also be embodiments of the present invention. The present invention also includes variations of the embodiments conceived by those skilled in the art unless they depart from the spirit and scope of the present invention, that is, the wording in the claims.

Figure 9:
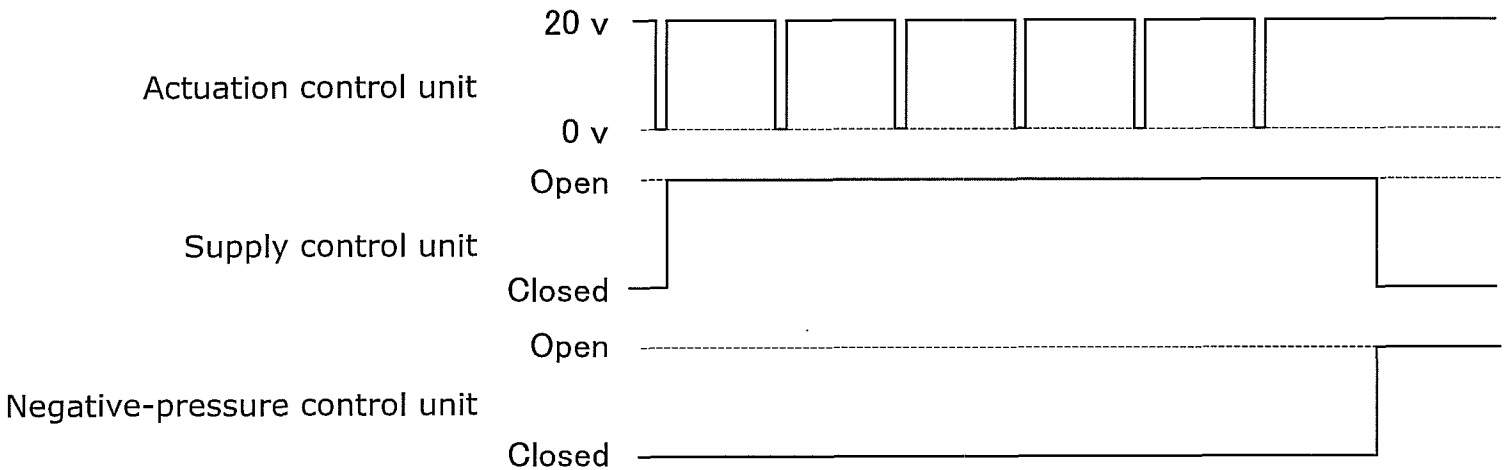
FIG. 9 is a timing chart showing shifts in operations of the liquid discharge device.

For example, as FIG. 9 shows, when the first valve 131 is opened by the supply control unit 132 and the liquid 201 is being supplied to the storage chamber 110 and the discharge hole 117, the actuation control unit 104 may operate the actuating unit 114 once or multiple times to discharge the liquid 201.

In this case, by making the discharge span of the liquid 201 constant, a substantially accurate amount of the liquid 201 can be discharged. This is effective when multiple droplets of the liquid are to be discharged in one location on the object to be coated 204 because it is possible to apply an amount of the liquid 201 exceeding one droplet the liquid 201 to a single location.

Figure 10:
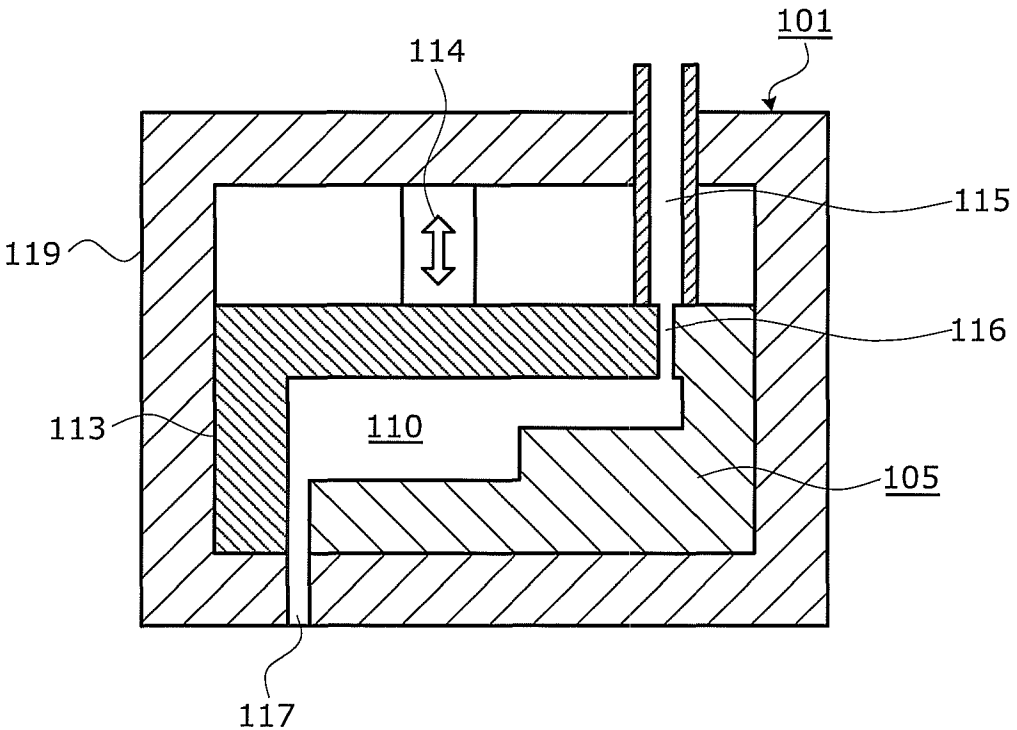
FIG. 10 shows a cross-section of another embodiment of the discharge unit.

It is to be noted that the shape of the elastic discharge part 105 is not limited to the above embodiment. For example, as FIG. 10 shows, a elastic discharge part 105 in which at least one surface of the rectangular box-shaped elastic discharge part 105 is formed of the elastic component 113 (two of the surfaces are formed of the elastic component 113 in FIG. 10) is acceptable. In this case, the actuating unit 114 disposed between the housing 119 and the elastic component 113 may directly distort the elastic component 113 to increase the volumetric capacity of the storage chamber 110, whereby the liquid 201 fills the storage chamber 110 and the discharge hole 117 from the supply path 115 via the supply hole 116 and is discharged.

Moreover, the pressurizing unit 102 may include a regulator, for example, for regulating pressure (positive pressure), and the negative pressurizing unit 180 may include a regulator, for example, for regulating pressure (negative pressure).

Moreover, the elastic discharge part may include: a first component which forms a portion of the storage chamber; and a second component in which the discharge hole is provided, and the elastic component may be disposed between the first component and the second component.

Furthermore, the liquid discharge device may include a synchronizing unit configured to synchronize control for starting the supply of the liquid by the supply control unit and control for discharging the liquid by the actuation control unit.

With this, it is possible to rapidly fill the storage chamber and the discharge hole since the liquid is supplied under pressure directly after being pressurized.

Furthermore, the liquid discharge method may include discharging the liquid in a supply period for supplying the pressurized liquid, the discharge being performed by the actuating unit under control of the actuation control unit.

With this, it is possible to discharge an adequate amount of liquid even if the discharge interval is shortened by supplying the pressurized liquid while the liquid is being discharged, and therefore the a relatively large amount of liquid can be accurately supplied.

INDUSTRIAL APPLICABILITY

The present invention is capable of accurately controlling the volume of and rapidly discharging a droplet, regardless of the type of liquid. As such, the present invention is applicable in forming thin, even films with various patterns in the manufacturing of various devices such as liquid crystal display panels, circuit boards, or LED elements. Moreover, the present invention is applicable in forming films which produce white light from monochromatic luminous bodies by discharging thereon a liquid dispersed with phosphor solid matter in phosphor coating processes for LED elements, for example.

REFERENCE SIGNS LIST

100 liquid discharge device
101 discharge unit
102 pressurizing unit
103 supply control unit
104 actuation control unit
105 elastic discharge part
107 negative-pressure source
108 negative-pressure supply control unit
109 main control apparatus
110 storage chamber
111 first component
112 second component
113 elastic component
114 actuating unit
115 supply path
116 supply hole
117 discharge hole
118 electrode
119 housing
120 biasing unit
131 first valve
132 supply control unit
180 negative pressurizing unit
181 second valve
182 negative-pressure control unit
191 synchronizing unit
201 liquid
202 head transporter
203 stage transporter
204 object to be coated
206 work base
210 supply source
211 syringe
212 plunger
213 holding chamber
214 pressure regulating chamber
215 flexible portion
221 head
231 stage

The invention claimed is:

1. A liquid discharge device comprising a discharge unit configured to discharge a droplet of a liquid including:

an elastic discharge part including a storage chamber at least partially formed of an elastic component, a supply hole which leads to the storage chamber and through which the liquid is supplied to the storage chamber, and a discharge hole through which the liquid stored in the storage chamber is discharged; and an actuating unit configured to vary a volumetric capacity of the storage chamber, and the liquid discharge device further comprising:

a pressurizing unit configured to pressurize the liquid to be supplied to the storage chamber to a pressure within a stable range;

a supply control unit configured to control whether the pressurized liquid is supplied to the storage chamber; and an actuation control unit configured to control operation of the actuating unit.

2. The liquid discharge device according to claim 1, further comprising a negative pressurizing unit configured to apply a negative pressure to the liquid in the storage chamber to equalize a pressure of the liquid with the atmospheric pressure.

3. The liquid discharge device according to claim 2, further comprising a supply source including a syringe and a plunger, the supply source holding, in the syringe, the liquid to be supplied to the storage chamber, wherein the plunger includes a flexible portion that is flexible in a moving direction of the plunger, the syringe includes a sealed pressure regulating chamber on a side of the plunger opposite to a holding chamber which holds the liquid, and the negative pressurizing unit is configured to apply a negative pressure to the liquid by transporting gas from inside the pressure regulating chamber to outside the pressure regulating chamber.

4. A liquid discharge method for discharging a liquid as a droplet using a discharge unit including: an elastic discharge part including a storage chamber at least partially formed of an elastic component, a supply hole which leads to the storage chamber and through which the liquid is supplied to the storage chamber, and a discharge hole through which the liquid stored in the storage chamber is discharged; and an actuating unit which varies a volumetric capacity of the storage chamber, the liquid discharge method comprising:

pressurizing the liquid to be supplied to the storage chamber to a pressure within a stable range;

controlling whether the pressurized liquid is supplied to the storage chamber using the control unit; and discharging the liquid by controlling operation of the actuating unit using the actuation control unit.

5. A liquid discharge device comprising a discharge unit configured to discharge a droplet of a liquid including:

an elastic discharge part including a storage chamber at least partially formed of an elastic component, a supply hole which leads to the storage chamber and through which the liquid is supplied to the storage chamber, and a discharge hole through which the liquid stored in the storage chamber is discharged; and an actuating unit configured to vary a volumetric capacity of the storage chamber, and the liquid discharge device further comprising:

a pressurizing unit configured to pressurize the liquid to be supplied to the storage chamber to a pressure greater than atmospheric pressure;

a supply control unit configured to control whether the pressurized liquid is supplied to the storage chamber; and an actuation control unit configured to control operation of the actuating unit;

a supply source including a syringe and a plunger, the supply source holding, in the syringe, the liquid to be supplied to the storage chamber, wherein the plunger includes a flexible portion that is flexible in a moving direction of the plunger, and the syringe includes a sealed pressure regulating chamber on a side of the plunger opposite to a holding chamber which holds the liquid, and the liquid discharge device further comprising:

a negative pressurizing unit configured to apply a negative pressure to the liquid by transporting gas from inside the pressure regulating chamber to outside the pressure regulating chamber.

* * * * *